US006118060A

United States Patent [19]

Van Doren

[11] Patent Number: 6,118,060

[45] Date of Patent: Sep. 12, 2000

[54] TIES FOR THE MOUTHPIECE OF A SINGLE REED WIND INSTRUMENT

[75] Inventor: Bernard Van Doren, Paris, France

[73] Assignee: Estabilssements Vandoren, Paris, France

[21] Appl. No.: 08/973,692

[22] PCT Filed: Apr. 2, 1997

[86] PCT No.: PCT/FR97/00586

§ 371 Date: Dec. 2, 1997

§ 102(e) Date: Dec. 2, 1997

[87] PCT Pub. No.: WO97/38414

PCT Pub. Date: Oct. 16, 1997

[30] Foreign Application Priority Data

Apr. 4, 1996 [FR] France ..... 96/04244

[51] Int. Cl.[7] ..... G10D 9/02

[52] U.S. Cl. ..... 84/398; 84/383 R; 84/398

[58] Field of Search ..... 84/383 R, 298, 84/398; 24/455; 248/317, 398

[56] References Cited

U.S. PATENT DOCUMENTS

| | | |
|---|---|---|
| 1,680,159 | 8/1928 | McVicker . |
| 2,523,185 | 9/1950 | Bedford . |
| 3,390,856 | 7/1968 | VanBuren . |
| 4,210,055 | 7/1980 | Platamone . |

FOREIGN PATENT DOCUMENTS

| | | |
|---|---|---|
| 0 714 086 A1 | 10/1996 | European Pat. Off. . |
| 2 641 109 | 12/1988 | France . |
| 668002 | 3/1952 | United Kingdom . |

*Primary Examiner*—Bentsu Ro
*Assistant Examiner*—Kim Lockett
*Attorney, Agent, or Firm*—Vidas, Arrett & Steinkraus, P.A.

[57] ABSTRACT

A ligature (3) of flexible material and an interchangeable locking element (10) configured to releasably retain a reed (2) onto the mouthpiece (1) of a wind instrument. The ligature (3) includes two parts (5*a*, 5*b*) in spaced relation with their respective edges opposite and more or less parallel to the longitudinal axis of the mouthpiece. The circumference (and the radial clamping force) of the ligature may be varied by manipulating a transversely oriented clamping screw (9) which engages cylindrical elements (6*a*, 6*b*) which are rotatingly retained within the parts (5*a*, 5*b*). As the ligature is tightened, the radial force acts upon the interchangeable locking element (10) to tightly clamp a reed (2) between the mouthpiece (1) and the locking element (10). The interchangeable locking element (10) is provided with an outwardly extending protruding part (11) with a constricted slit (12) which is configured to releasably engage a central part (9*c*) on the clamping screw (9). The slit (12) enables the locking element (10) to be clipped onto or removed from the clamping screw (9). The locking element may be provided with different reed contacting surfaces which, when secured against a reed surface, produce different tonal qualities. When a different tonal quality is desired, only locking elements rather than entire ligatures need be exchanged.

8 Claims, 2 Drawing Sheets

TIES FOR THE MOUTHPIECE OF A SINGLE REED WIND INSTRUMENT

BACKGROUND

This invention concerns improvements made to the ligatures for the mouthpiece of a single reed wind instrument. More particularly, it concerns a ligature for the mouthpiece of a wind instrument having a locking element and a means to distribute the clamping stress, leaning on the reed or on the mouthpiece of the instrument.

It is known, that in instruments such as the clarinet or the saxophone, the reed is maintained in place on the mouthpiece of the instrument by a clamp collar, called a ligature, which fits the general form of the mouthpiece and leans on the external rounded side of the reed, so that the flat side of the clamp is in contact with the flat side of the mouthpiece.

The ligature is slit along one of its generating lines, and assembled such that screws and threaded pins are placed on the two parts which face each other, in order to attach them, one to the other, to thus create a clamping action on the reed.

These ligatures can have many clamping screws (see FR-A-2 438 311) or only one single clamping screw (see U.S. Pat. No. 3,618,440 or U.S. Pat. No. 5,623,111.

These ligatures preferably have a rigid element of a curved shape that complements that of the mouthpiece of the clarinet or of the reed, which serves as a locking element and is placed between the mouthpiece or the reed and the opposite parts of the ligature, in order to be usually applied against the mouthpiece or the reed.

In this configuration, the clamping stress is exerted between the screw in the direction of its axis and thus is transformed into a pressure exerted on the locking element placed between the body of the ligature and the mouthpiece or the reed of the instrument, perpendicular to the mouthpiece, which conveys itself by an even more balanced distribution of the stress exerted by the ligature onto the mouthpiece and the reed of the instrument.

Commonly, on the surface turned towards the reed or the mouthpiece, the locking element usually has parts having a predetermined shape, for example, longitudinal ribs obtained by the stamping of this surface, which contributes to a greater distribution of the clamping stress and/or to an improved locking of the reed onto the instrument.

It is important to note that the clamping stresses exerted by locking elements having different predetermined shapes will result in different tonal characteristics. For example, the tone produced using a locking element with longitudinal ribs is different than the tone produced using a locking element with transverse ribs or a locking element with plurality of protrusions.

Musicians thus have choices as to the type of locking element and it often happens that they change the locking element according to how they interpret the score.

Inasmuch as the locking element is attached to the ligature, replacing this element is not very practical. In order to change a tonal quality, and the musician must replace the ligature itself with another ligature equipped with another locking element. This supposes, however, that there are several ligatures available, which could become expensive.

SUMMARY

This invention aims to remedy this inconvenience by proposing a new ligature having a removable locking element, which can be attached to the ligature by simply clipping onto one or more elements which join the straight edges crosswise arranged opposite the ligature and, more importantly, onto the clamping screw or screws of this ligature, to a part protruding from this locking element inserted between the edges opposite the ligature.

To this effect, the object of the invention is a pliable ligature made of a flexible, bendable material, made to fit the mouthpiece of a reed wind instrument, having a contour that is more or less complementary to that of the mouthpiece, in order to be able to clamp it and a reed placed between the mouthpiece and the ligature, to parts spaced out from the ligature having edges that are arranged facing each other respectively which are more or less parallel to the generating line longitudinal axis of the mouthpiece, these two parts being joined by at least one clamping screw arranged crosswise between its two parts and working with a threaded pin on at least one of its parts, a rigid locking element in a shape that complements the reed or the instrument mouthpiece placed between the ligature and this reed or this mouthpiece, this ligature characterized by the fact that the locking element is removable and able to be clipped to a clamping screw or screws of the ligature.

The protruding part of the locking element can simply have one or more slits able to cover the clamping screw or screws and the opening of which has a space slightly less than the diameter of the screw or screws and is the length of the rest of the slit.

The slit of this protruding part can also have a collapsible element arranged crosswise to the slit and able to collapse against the flexible means such as with a return spring.

The surface of the locking element assigned to come into contact with the reed or with the mouthpiece can naturally have protruding parts of any shape, for example ribs arranged lengthwise or crosswise in relation to the mouthpiece, or of any other shape, arising from the stamping of this surface and able to bend or not under the clamping pressure.

One such locking element which can be firmly attached to the ligature by clipping it onto the clamping screw or screws constitutes, of course, another purpose of the invention.

The ligature according to the invention thus presents the great advantage, in relation to other ligatures using the aforementioned technique, that the musician can easily replace the locking element with which it is equipped with another locking element, without having to undergo any complicated operation.

Furthermore, he can, at a reduced cost, at once have a set of replaceable locking elements of various types, which can be clipped to the clamping screw or screws of a single ligature.

BRIEF DESCRIPTION OF THE DRAWINGS

Various ways to make this invention are described below, and which reference the attached drawings, which are non limitative. On these drawings.

DETAILED DESCRIPTURE

Figure 1:
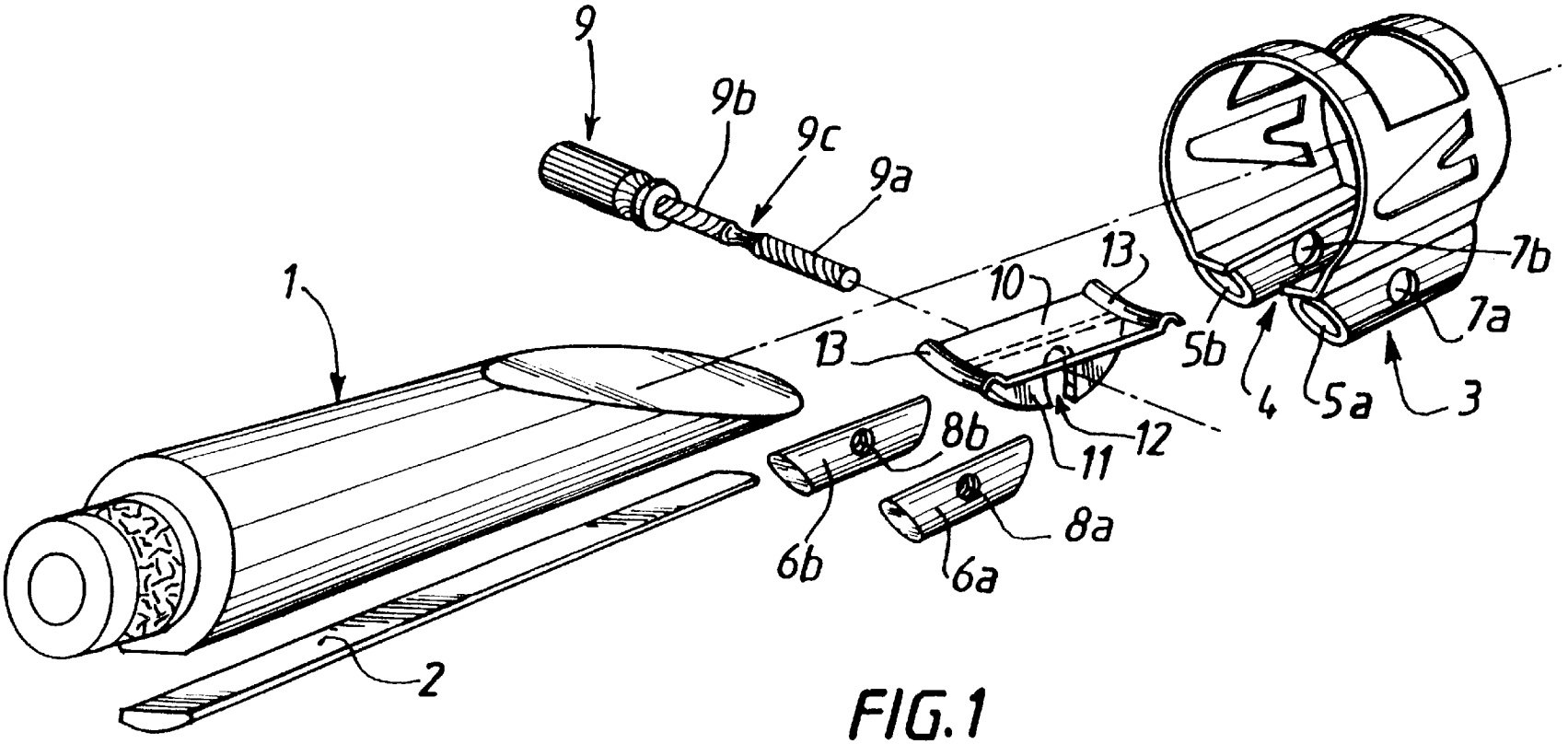
FIG. 1 is a perspective view of a mouthpiece of a clarinet and of a ligature according to the invention.
Figure 2:
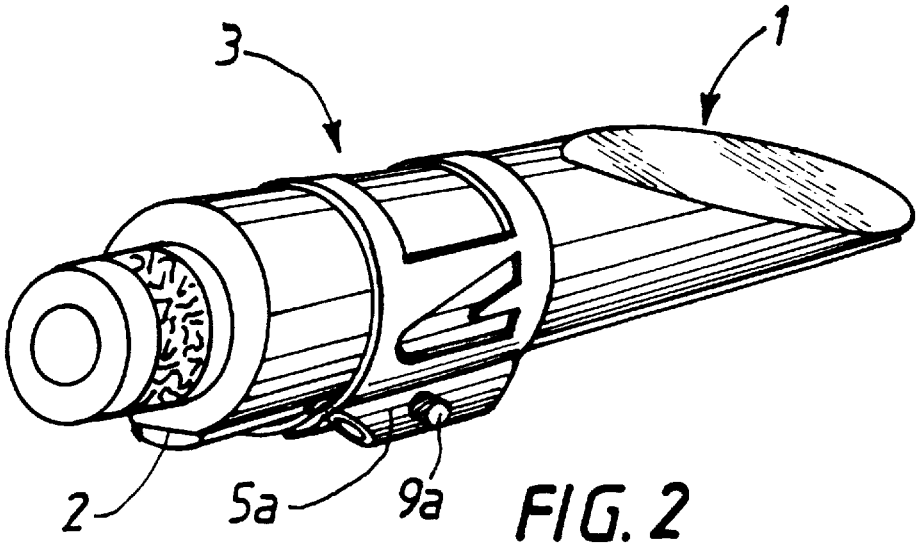
FIG. 2 is a perspective view of the mouthpiece of a clarinet equipped with this ligature.

First we will reference FIGS. 1 and 2.

In these drawings, the mouthpiece of the clarinet is designated by reference 1, the reed by reference 2, and the body of the ligature intended to hold the reed 2 of the mouthpiece 1 by reference 3. The body of the ligature is made of a pliable, flexible material, for example metal or plastic, and it has a generally cylindrical shape following the shape of the mouthpiece 1 and of the reed 2. The body of the ligature is split 4, parallel to the generating lines of the mouthpiece and the reed 2, in such a way as to include two opposite parts, so that they can be put together or taken apart, to clamp or unclamp the reed 2.

The body of the ligature represented herein is the type that was the purpose of the previously mentioned U.S. Pat. No. 5,623,111, but it can of course be of any other type.

In this configuration, each of the parts facing the body 3 has a cover (sheath), respectively 5*a*, 5*b*, in which a cylindrical element 6*a*, 6*b* is housed in such a way as to be able to pivot or rotate freely around its axis, respectively.

In the covers 5*a*, 5*b*, ports 7*a*, 7*b*, are placed, whereas elements 6*a*, 6*b* have two holes 8*a*, 8*b*, drilled crosswise opposite these two ports, threaded on the inside, the threads forming two bores having inverted paths.

A screw 9 having two threaded parts shifted forward 9*a*, 9*b*, with inverted threads, complementary to that of holes 8*a*, 8*b*, is placed in the latter, by means of ports 7*a*, 7*b*, of the cover 5*a*, 5*b*.

So as not to invert the threads of parts 9*a*, 9*b*, of the screw 9, on the one hand, and of the holes 8*a*, 8*b*, on the other hand, it is possible to clamp the ligature or to unclamp the ligature 3 to the mouthpiece 1 and the reed 2, by perfectly and symmetrically distributing the stress exerted on the two parts 5*a*, 5*b*.

One locking element 10, which has a curved contour which complements that of the reed 2, is placed between it and parts 5*a*, 5*b*, of the ligature 3 and, according to the invention, it includes a protruding part 11, placed between the parts 5*a* and 5*b* where a slit 12 is clipped to the central part having the smallest diameter 9*c*, of the screw 9, separating the threads 9*a* and 9*b* of the screw.

In this case, the clipping is assured in a simple manner by placing at the opening of the slit 12 a spacing of the opposite parts which is slightly smaller than the diameter of the part 9*c* and shorter than the normal length of the slit 12. As indicated above, one can also have at the opening of the slit 12, a collapsible element, which can be slipped out by prompting from part 9*c* of the screw 9 and which can then be placed back in position by a return spring.

Figure 3:
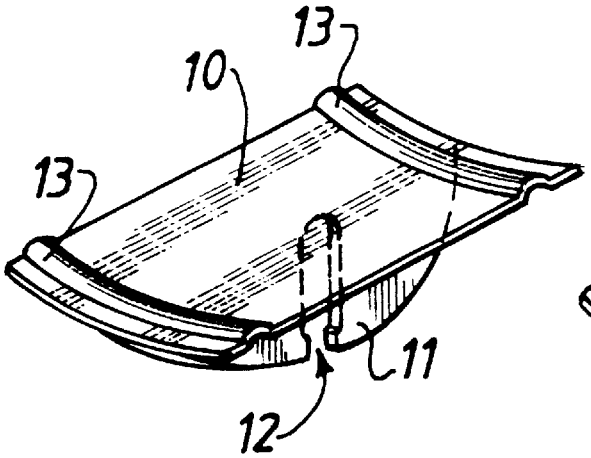
FIGS. 3, 4 and 5 are perspective views in a greater scale of three variations of the locking element of the ligature.

The locking element 10, which is represented in very large scale in FIG. 3, has, in two perpendicular planes on the axis of the mouthpiece 1, ribs 13, which protrude in the direction of the mouthpiece and allow for a progressive clamping of the reed.

Figure 4:
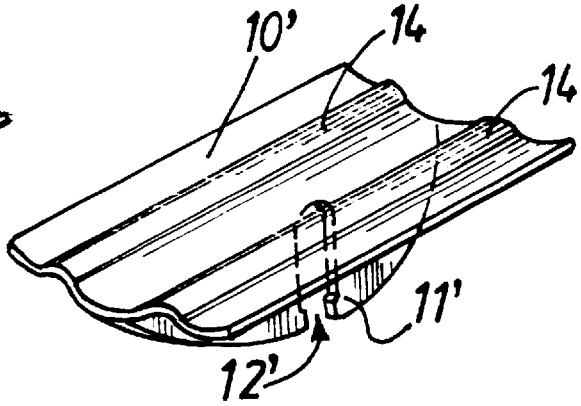
Figure 5:
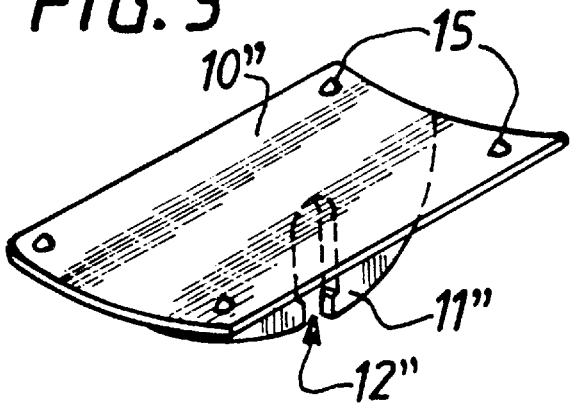

In a variation of the locking element in FIG. 4, where elements previously described are designated by the same reference numbers with an ' added to the number, the ribs 14 are longitudinal, that is to say parallel to the axis of the mouthpiece 1', so that in the variation in FIG. 5, where the elements previously described are likewise designated by the same reference numbers, but with an " added to the number, the locking element 10" does not have any ribs, but rather protruding parts 15, stemming from the bending of element 10".

One can thus see, that, according to this invention, there is a considerable advantage with this ligature, which lends itself to a rapid change in the type of locking element used by the musician, after having released the ligature of the mouthpiece, without having to completely unscrew screw 9, as in the previous technique where this screw was placed in a port in the protruding part 11, which required a complete detachment of the screw and of part 11 in order to change the locking element.

Although the way to implement the invention which has just been described concerns a ligature having one single clamping screw, it is clear that the invention applies just as well to ligatures having two parallel clamping screws. In that case, the part that protrudes from the locking element between the parts placed opposite the ligature will have two slits, which will be clipped onto the two clamping screws.

As indicated above, one single ligature can thus be sold with a complete batch of interchangeable locking elements that the professional or amateur musician can choose according to the music he wishes to interpret.

What is claimed is:

1. A ligature for fastening a reed onto a mouthpiece of a wind instrument, the ligature comprising:

a body having a shape which is generally complementary to and conformable with the profile of a mouthpiece of a wind instrument, the body including a pair of parallel sheaths which define a split, the split generally parallel to the longitudinal axis of the mouthpiece; the sheaths adjustably connected to each other by a crosswise oriented clamping screw and, a locking element having a longitudinal axis, the locking element having a protruding part defining a crosswise-oriented slit configured to slidingly admit the crosswise-oriented clamping screw in a confining relation;

wherein the locking element may be releasably connected to the ligature without having to disconnect the clamping screw from the parallel sheaths.

2. The ligature of claim 1, wherein the protruding part extends generally away from the mouthpiece.

3. The ligature of claim 1, the protruding part further defining a gap, the gap smaller than the diameter of the clamping screw to effectively form a clip;

wherein the locking element is snappingly attachable to and removable from the clamping screw as the crosswise slit engages the clamping screw.

4. The ligature of claim 3, wherein the protruding part extends generally away from the mouthpiece.

5. The ligature of claim 3, the clamping screw further comprising a central part configured to be received within the crosswise slit of the locking element.

6. The ligature of claim 5, further comprising at least one threaded pin, the threaded pin rotatingly received within one of the sleeves and configured to engage the threads of the clamping screw.

7. An improved ligature for attaching a reed to a mouthpiece of a wind instrument, the ligature of the type having a body with a shape which is generally complementary to and conformable with the profile of a mouthpiece of a wind instrument, the body having opposable ends which are adjustably connected to each other by a crosswise-clamping screw; and a locking element configured to exert a clamping force against a reed to retain the reed against a mouthpiece, the improvement comprising:

a protruding part which extends from the locking element in a direction away from the mouthpiece, the protruding part defining a slit which is configured to slidingly admit the clamping screw;

wherein the locking element may be releasably connected to the ligature without having to disconnect the clamping screw form the opposable ends of the ligature.

8. The improved ligature of claim 7, the protruding part further defining a gap, the gap smaller than the diameter of the clamping screw to effectively form a clip;

wherein the locking element is snappingly attachable to and removable from the clamping screw as the crosswise slit engages the clamping screw.

* * * * *